US006285286B1

(12) United States Patent
Tyrén et al.

(10) Patent No.: US 6,285,286 B1
(45) Date of Patent: Sep. 4, 2001

(54) ANTI-THEFT DEVICE WITH A THERMALLY CONTROLLABLE LOCKING MECHANISM

(75) Inventors: Carl Tyrén, Saint Roman (MC); Christian Quinones, Solliés-Pont (FR)

(73) Assignee: RSO Corporation N.V., Curacao (NL)

( * ) Notice: Subject to any disclaimer, the term of this patent is extended or adjusted under 35 U.S.C. 154(b) by 0 days.

(21) Appl. No.: 09/509,267

(22) PCT Filed: Sep. 29, 1998

(86) PCT No.: PCT/SE98/01727

§ 371 Date: May 24, 2000

§ 102(e) Date: May 24, 2000

(87) PCT Pub. No.: WO99/18312

PCT Pub. Date: Apr. 15, 1999

(30) Foreign Application Priority Data

Oct. 2, 1997 (SE) ..... 9703623

(51) Int. Cl.[7] ..... G08B 13/14

(52) U.S. Cl. ..... 340/572.9; 340/426; 340/572.8

(58) Field of Search ..... 340/572.1, 572.8, 340/572.9, 542, 426; 70/57.1, 282, DIG. 10; 292/DIG. 66

(56) References Cited

U.S. PATENT DOCUMENTS

| | | | | |
|---|---|---|---|---|
| 3,806,910 | * | 4/1974 | Keifer et al. | 340/572.9 |
| 4,072,867 | | 2/1978 | Goodlaxson | 307/118 |
| 4,380,097 | | 4/1983 | Keifer | 340/572.9 |
| 4,575,706 | * | 3/1986 | Heidman, Jr. | 340/426 |
| 4,617,448 | | 10/1986 | Goldowsky | 219/200 |
| 5,077,872 | | 1/1992 | Guthammer | 24/704.1 |
| 5,211,183 | | 5/1993 | Wilson | 600/585 |
| 5,905,446 | * | 5/1999 | Benore et al. | 340/542 |

FOREIGN PATENT DOCUMENTS

| | | |
|---|---|---|
| 3820877 | 6/1988 | (DE) . |
| G 90 01 907 | 2/1990 | (DE) . |
| 0 212 061 | 4/1986 | (EP) . |

OTHER PUBLICATIONS

International Search Report for PCT/SE98/01727 dated Feb. 15, 1999.

* cited by examiner

*Primary Examiner*—Van T. Trieu
(74) *Attorney, Agent, or Firm*—Merchant & Gould P.C.

(57) ABSTRACT

An anti-theft device (10) for deterring theft of a protected article has first and second housing elements (12,16) and a locking mechanism (20) for securing a male portion (17) of the second housing element (16) to a female portion of the first housing element (12). The locking mechanism releases the male portion from the female portion, when actuated by an unlocking device operated by an authorized person. A thermally controllable element (36,42) assumes a first position during normal temperatures, wherein the locking mechanism (20) is kept in a locked state, and a second position when heated to temperatures above a predetermined limit, wherein the locking mechanism is caused to release the male portion (17) from the female portion of the first and second housing elements (12,16).

19 Claims, 3 Drawing Sheets

ANTI-THEFT DEVICE WITH A THERMALLY CONTROLLABLE LOCKING MECHANISM

TECHNICAL FIELD

The present invention relates to an anti-theft device for deterring theft of a protected article, the device comprising first and second housing elements and a locking mechanism for securing a male portion of the second housing element to a female portion of the first housing element, the locking mechanism being arranged to release the male portion from the female portion, when actuated by an unlocking device operated by an authorized person.

DESCRIPTION OF THE PRIOR ART

Anti-theft devices of the kind described above are used for deterring theft of protected articles or goods, especially in shops or stores. It is of particular interest for the owner of a shop to protect attractive and easily removable articles, such as clothes, handbags, shoes, etc, by attaching an anti-theft device to each article. The attachment is made in such a manner, that the anti-theft device can only be removed from the protected article by means of a dedicated unlocking device, which only authorized persons have access to. The anti-theft device is often provided with at least one glass ampoule containing a discoloring or ill-smelling fluid. Furthermore, the anti-theft device is designed in a way, so that the glass ampoule will break and start leaking, if an unauthorized person, such as a thief, tampers with the anti-theft device in an attempt to remove the device from the protected article. Hence, since the broken glass ampoule will immediately stain or contaminate the article and make it useless for all practical purposes, a potential thief is discouraged from such a tampering attempt.

As an alternative to the fluid-containing ampoule(s), the anti-theft device may be provided with sensor or transponder means detectable by an electronic article surveillance system (EAS). The anti-theft device may for instance be provided with a thin metal strip of an amorphous magnetic alloy. The magnetic properties of the metal strip are controllable by means of an alternating magnetic field generated by external means, such as inductive detection arcs. Such transponders or sensors are for instance disclosed in U.S. Pat. No. 5,469,140, U.S. Pat. No. 5,414,412, U.S. Pat. No. 5,406,262 and WO97/29463.

U.S. Pat. No. 5,275,122 discloses an anti-theft device as described above, which is intended to be attached to an attractive article for the protection thereof. The device comprises a first element with a connecting pin to be inserted through the article, and a second element, which is intended for attachment to the connecting pin. The first element includes a fragile ampoule containing a staining liquid, said ampoule breaking upon manipulation of the anti-theft device. The first element acts as a device base element, while the second element acts as a locking element or head, which is mounted on the pin of the base element so as to firmly secure the protected article between the first and the second elements. For this purpose the head comprises a locking device, which is designed so that the head may easily be moved along the axial direction of the pin in one direction only, namely towards the base element, whereas any attempt to move the head in the opposite direction, i.e. away from the base element, will cause the head to be immediately locked to the pin.

The locking mechanism in the head includes a number of small metallic retaining balls, which are disposed in internal grooves in the head, in a way so that the retaining balls are firmly clamped against the pin and the bottom of the grooves, when the head is drawn outwards, while allowing the head to be moved inwardly along the pin. Hence, the locking mechanism of the anti-theft device acts as a one-way coupling, which may be rendered inoperative (i.e. to release the head from the pin) only by means of an appropriate unlocking device, said unlocking device only being available to authorized personnel.

U.S. Pat. No. 4,012,813 relates to a fastening device for securing articles together, the device including releasably connected male and female components. The male component comprises a pin, whereas the female component comprises a magnetic retaining insert positioned in a housing for releasably clamping the pin. When joined, the pin cannot be separated from the retainer, unless a special tool is used. Since the insert is of magnetic material, an actuating tool including an electromagnet may be used for actuating the insert to permit removal of the pin. The fastening device is intended to be used in an anti-theft tag, comprising an electrical circuit, which activates an alarm, if the tag has not been properly removed when a checkout point is passed. Similar anti-theft locking devices are disclosed in U.S. Pat. No. 4,221,025, U.S. Pat. No. 4,903,383, U.S. Pat. No. 5,054,172, U.S. Pat. No. 5,031,287 and U.S. Pat. No. 4,483,049.

U.S. Pat. No. 5,140,836 discloses a clamp for use as a theft deterrent device, comprising a U-shaped member having first and second legs including a shelf disposed on the inside of each leg. Furthermore, a clamp housing has a pair of longitudinal channels for receiving the legs of the U-shaped member as well as means provided with a row of teeth for engaging the shelves on the U-shaped member, so as to prevent removal of the U-shaped member from the longitudinal channels. The housing comprises a magnetically attractive element, which when attracted by an external magnetic field is movable to such a position, in which the teeth are disengaged from the shelves, so that the U-shaped member may be removed from the housing. A similar magnetically releasable clamp is disclosed in U.S. Pat. No. 5,337,459, where an U-shaped member is engaged by means of retaining balls rather than teeth.

A common drawback of the previously known anti-theft devices described above is that the locking mechanism thereof (i.e. the one-way coupling which allows the male portion—pin or U-shaped member—to be inserted into the female portion of the device, while preventing the male portion from being separated from the female portion, unless actuated by the unlocking device) may be actuated by other means than the intended unlocking device. For instance, the knowledge about the magnetically releasable locking mechanism inside conventional anti-theft devices is most likely well-spread among criminal individuals, such as shop-lifters. Hence, a shop-lifter may easily bring his or her own permanent magnet, or possibly electromagnet, into the shop and use the magnet for releasing the male portion from the female portion, so as to remove the anti-theft device from the desired article. Then, nothing stops the thief from stealing the article.

SUMMARY OF THE INVENTION

An object of the present invention is to prevent unauthorized people from removing the anti-theft devices from protected articles by using their own "home-made" unlocking device, such as a permanent magnet or, possibly, a battery-powered electromagnet.

The object of the invention is achieved for anti-theft devices, comprising first and second housing elements and a locking mechanism for securing a male portion (e.g. a pin) of the second housing element to a female portion (comprising e.g. spring biased retaining balls) of the first housing element, the locking mechanism being arranged to release the male portion from the female portion, when actuated by an unlocking device operated by an authorized person, by providing the locking mechanism with a thermally controllable element, which is arranged to assume a first position during normal temperatures, wherein the locking mechanism is kept in a locked state, and a second position when heated to temperatures above a predetermined limit, wherein the locking mechanism is caused to release the male portion from the female portion of the first and second housing elements.

Other objects, aspects and features of the present invention are defined by the subsequent dependent claims.

BRIEF DESCRIPTION OF THE DRAWINGS

Preferred and alternative embodiments of the present invention will now be described in more detail, reference being made to the accompanying drawings, in which.

DETAILED DISCLOSURE OF THE INVENTION

Figure 1:
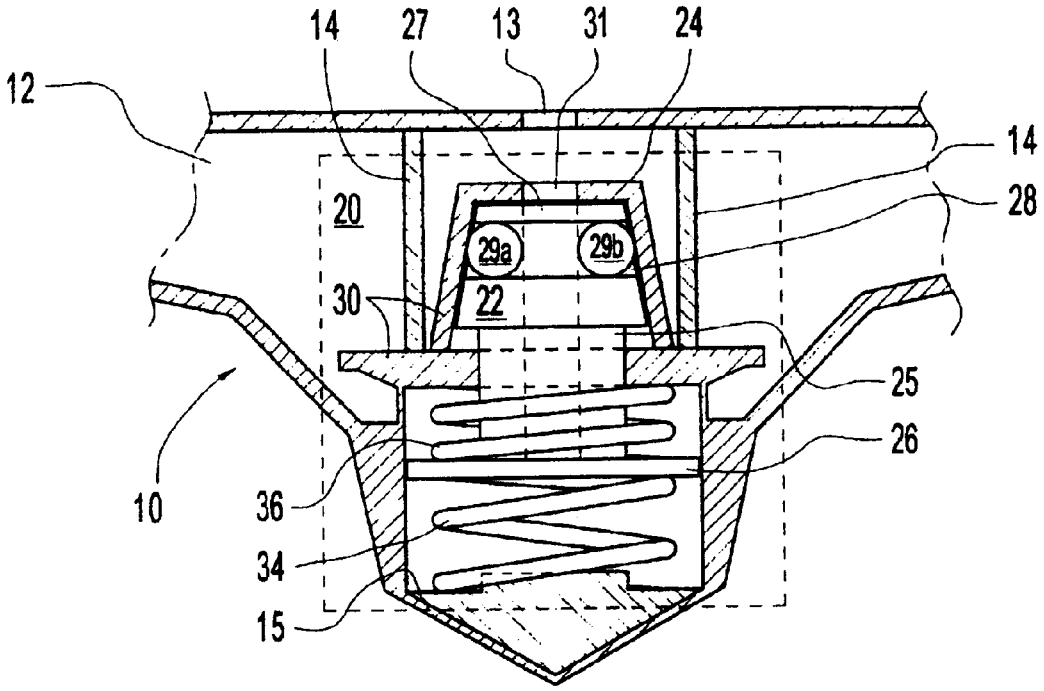
FIG. 1 is a schematic sectional view of the locking mechanism in an anti-theft device according to a preferred embodiment.

FIG. 1 discloses, in a schematic way, the locking mechanism in an anti-theft device 10 according to a preferred embodiment of the present invention. The anti-theft device 10 comprises a first housing element 12, which acts as a base element for the anti-theft device and which, apart from the elements disclosed in the drawing, may contain conventional theft-deterrent means known from the prior art, such as glass ampoules containing a discoloring or ill-smelling fluid or transponder means for responding to an interrogation signal, as will be described in more detail later.

Comprised in the first housing element 12 is a locking mechanism 20, which is contained within a dashed frame in FIG. 1. The locking mechanism 20 comprises a spring biased piston 22, which is movable in the axial direction (i.e. in the vertical direction in FIG. 1) within certain limits, as will be described below. The piston 22 has an upper conical portion 24, a lower base portion 26 and an cylindrical intermediate portion 25 between the upper portion 24 and the base portion 26. Furthermore, the piston 22 is provided with a coaxial bore 27 extending along the axial direction of the piston 22 through the conical portion 24, the intermediate portion 25 and the base portion 26, as well as a transversal bore 28 extending through the upper conical portion 24 in a direction perpendicular to the axial direction of the piston 22. The transversal bore 28 is arranged to receive two metallic retaining balls 29*a* and 29*b*, the diameter of the bore 28 being only slightly larger than the diameter of the retaining balls 29*a* and 29*b*, so that the retaining balls will fit precisely inside the transversal bore 28.

Furthermore, the locking mechanism 20 comprises a conical metal sleeve 30, which includes an opening 31 aligned with the coaxial bore 27 inside the piston 22. The conical sleeve 30 is firmly mounted inside the first housing element 12 by way of a supporting structure 14.

A biasing spring 34 is arranged in a cavity formed between the bottom of the base portion 26 of the piston 22 and the bottom interior surface 15 of the first housing element 12. The biasing spring 34 is preferably made of metal, has a conventional design and has the purpose of biasing the piston 22 in a direction towards the upper portion of the conical sleeve 30. When the upper conical portion 24 of the piston 22 is biased towards the upper interior surface of the conical sleeve 30, the retaining balls 29*a* and 29*b* contained inside the transversal bore 28 make contact with the lateral interior surfaces of the conical sleeve 30, thereby forcing the retaining balls inwardly towards each other, as will be described in more detail with reference to FIGS. 3 and 4.

Figure 2:
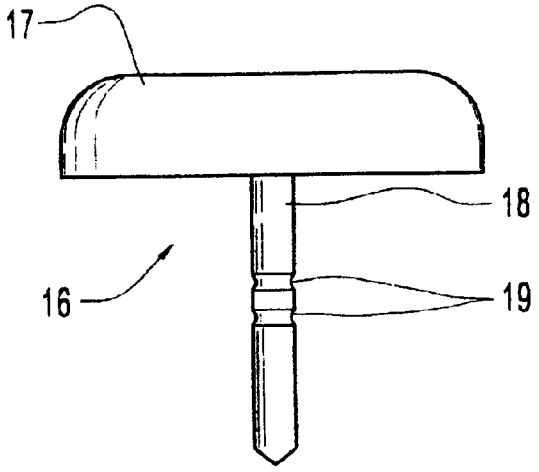
FIG. 2 is a schematic sectional view of a male portion of the anti-theft device according to the preferred embodiment.

The first housing element 12 is arranged to receive a second housing element 16, which is schematically disclosed in FIG. 2, through an opening 13 in the upper portion of the first housing element 12, through the opening 31 in the upper portion of the conical sleeve 30, and through the coaxial bore 27 inside the piston 22. The second housing element 16 has the form of a head 17, to which a pin 18 is mounted. The head 17 may, together with the first housing element 12, be made from plastics or any other suitable material, while the pin 18 is preferably made from metal. The pin 18 comprises a plurality of notches 19 for engagement with the retaining balls 29*a* and 29*b*, as will be described below.

A releasing spring 36 is arranged between the upper surface of the base portion 26 of the piston 22 and the bottom surface of the conical sleeve 30. The releasing, spring 36 is arranged to assume a first position during normal operating temperatures, such as temperatures below a predetermined threshold limit, which in accordance with the findings below may be set to a sufficiently high value, preferably exceeding 100° C. When the releasing spring 36 assumes its first position during normal operation, it does not exert any considerable force on the base portion 26 of the piston 22. Hence, at normal temperatures, the spring force of the biasing spring 34, which acts in a direction towards the upper portion of the conical sleeve 30 (i.e. upwards in FIG. 1), is much stronger than the spring force of the spring 36, which acts in an opposite direction towards the bottom 15 of the first housing element 12 (i.e. downwards in FIG. 1).

The operation when the anti-theft device 10 is to be applied onto an article is as follows. The pin 18 on the second housing element 16 is run through the article to be protected, for instance through a button hole or directly through the fabrics of for instance a piece of clothing. The pin 18 is essentially needle-shaped, which makes it easy for the tip of the pin 18 to perforate the article of protection without causing any particular damage to the latter. Then the pin 18, acting as a male connecting element, is inserted into the female portion of the first housing element 12 (i.e. the openings 13 and 31 as well as the coaxial bore 27). When the pin 18 contacts the surfaces of the retaining balls 29*a* and 29*b*, the latter are urged outwardly, until they reach contact with the interior lateral surfaces of the conical sleeve 30. Since the piston 22 is movably arranged in the axial direction thanks to the compressible biasing spring 34, the retaining balls 29*a* and 29*b* are given more space to move outwardly towards the lateral sides of the conical sleeve 30, when the piston 22 is pushed down by the entering pin 18.

Hence, the pin 18 may be fully inserted into the female portion of the first housing element 12.

Once the second housing element 16 has been attached to the first housing element 12, i.e. the pin 18 has been fully inserted into the female portion of the first housing element 12, the first and the second housing elements are prevented from being separated from each other. If an attempt is made to pull back the head 17, so as to remove the pin 18 from the interior of the first housing element 12, the piston 22 is forced upwardly due to the spring force exerted by the biasing spring 34. Since the sleeve 30 and the upper portion 24 of the piston 22 are both given a conical shape, the free space available for the balls 29*a* and 29*b* to move in is reduced, as the piston 22 moves upwards towards the upper interior surface of the sleeve 30. As a consequence, the distance between the retaining balls 29*a* and 29*b* are not big enough for releasing the pin 18. On the contrary, the retaining balls 29*a*–29*b* will firmly engage with the notches 19 in the pin 18, thereby securing the pin 18 inside the first housing element 12 and preventing the detachment of the second housing element 16 from the first housing element 12 and also preventing removal of the anti-theft device 10 from the protected article.

Figure 3:
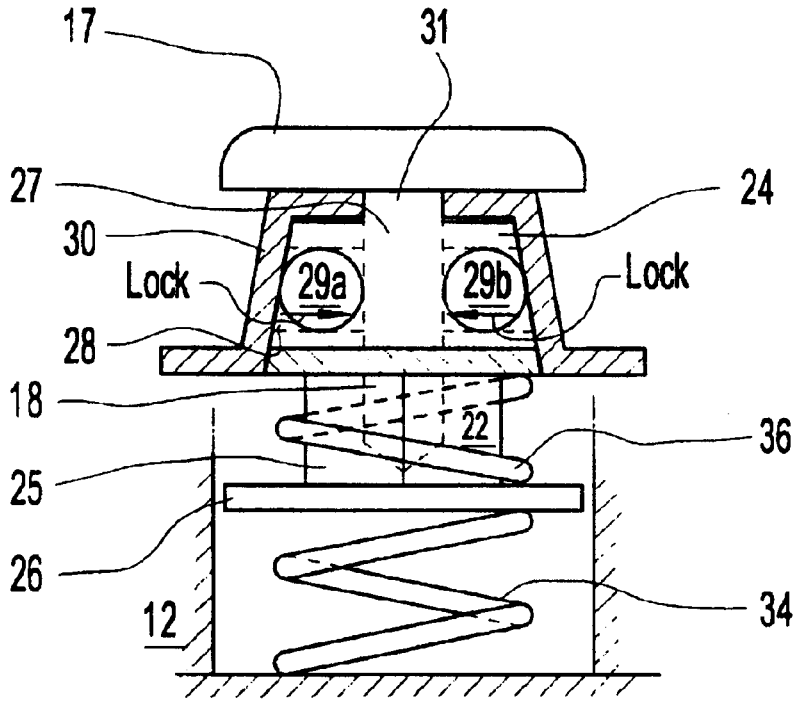
FIG. 3 is a schematic and simplified view of vital portions of the locking mechanism in a normal or locked state.
Figure 4:
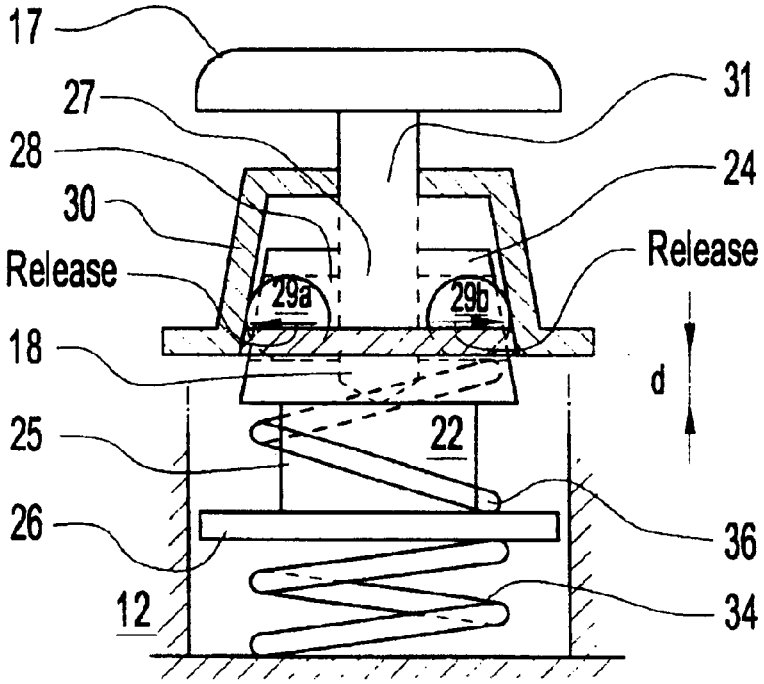
FIG. 4 is a schematic and simplified view of vital parts of the locking mechanism in a state of release.

The normal operating situation is further illustrated in FIG. 3, showing the pin 18 of the head 17 when fully inserted into the female portion of the first housing element 12, i.e. the opening 31 in the conical sleeve 30 as well as the coaxial bore 27 through the piston 22. As the piston 22 is pushed towards the top of the conical sleeve 30, the retaining balls 29*a* and 29*b* are pushed towards each other against the pin 18. Thus, if a potential thief tries to pull the head 17 and the pin 18 out of the coaxial bore 27, the small distance between the retaining balls 29*a* and 29*b* will prevent such removal. As a matter of fact, the pressure with which the retaining balls 29*a* and 29*b* engage the pin 18 increases as the strength with which the head 17 is pulled increases. Thus, the retaining balls 29*a* and 29*b* firmly secure the pin 18, in particular the notched portions 19.

The anti-theft device provides a way for an authorized person to release the male portion (i.e. the pin 18) from the female portion (i.e. the coaxial bore 27, the retaining balls 29*a*–29*b* and the conical sleeve 30) of the locking mechanism, without using any conventional unlocking means. Instead, the authorized person, e.g. a shop assistant at a cashier desk, will actuate an external device (not disclosed herein) for supplying thermal energy to the releasing spring 36. According to the preferred embodiment of the invention the releasing spring 36 is made from a metal, which exhibits a so called shape-memory effect (SME). Furthermore, according to the preferred embodiment the aforesaid external heating device is arranged to generate a high-frequency alternating magnetic field exposing the anti-theft device 10, wherein an electric current is induced in the releasing spring 36. As a consequence, the spring 36 is heated to a high temperature well above a predetermined limit, at which the shape-memory metal spring is caused to switch from its first or normal shape according to FIGS. 1 and 3 to a second shape according to FIG. 4. Compared to the normal compressed shape the second shape is more extended (since the length of the shape-memory spring 36 is considerably increased in the second position), wherein the spring force of the spring 36 is increased. Thus, the releasing spring 36 pushes the lower portion 26 of the piston 22 in a direction away from the top of the conical sleeve 30, thereby compressing the biasing spring 34.

As a result the upper conical portion 24 of the piston 22 is moved a distance d away from the top of the sleeve 30, thereby allowing more space for the retaining balls 29*a*–29*b*, which then are free to move outwardly. The engagement between the retaining balls 29*a*–*b* and the pin 18 thereby ceases, and the second housing element 16 (i.e. the head 17 and the pin 18) may be removed from the female portion of the first housing element 12. The authorized person may then remove the protected article from the pin 18, for instance in response to having received a sufficient amount of money from a customer as payment for the article.

In the preferred embodiment the releasing spring 36 has a length of about 2 mm in its normal state. When the spring is inductively heated to temperatures above 65° C., the length of the spring is increased to about 3–4 mm. The spring is made of a nickel-titanium alloy, such as Nitinol, which is commercially available from Raychem Inc. It has no magnetic properties and may hence not be manipulated by a permanent magnet or a home-made electromagnet of the kind, with which the prior art anti-theft devices described above may be manipulated. To form a closed current loop for the induced electric current, an electric conductor not shown in the drawings is connected between the respective ends of the spring 36.

The heating device used for inductively heating the releasing spring 36 may be a conventional inductive oven known per se. An importance advantage of using an inductive heating device is that no elements apart from the inductive releasing spring 36 will be heated. In particular, this means that there is no risk of damaging or burning the article, to which the anti-theft device 10 is attached.

The knowledge about the internal operating principle of the locking device may, undesiredly, become public knowledge among criminal individuals in the future. To avoid unauthorized people from unlocking the anti-theft device by supplying heat from their own source of heat, for instance by pouring very hot water from a thermos jug onto the anti-theft device, the releasing spring 36 may be designed in such a way, that the predetermined temperature limit for switching between the first and the second shapes is well above the boiling point of water, i.e. 100° C. As an alternative, the heating of the releasing spring 36 may be effectuated by electromagnetic means rather than inductive means. For instance, an external transmitter of electromagnetic radiation may be arranged to expose the anti-theft device 10 to radiowaves or microwaves.

Figure 5:
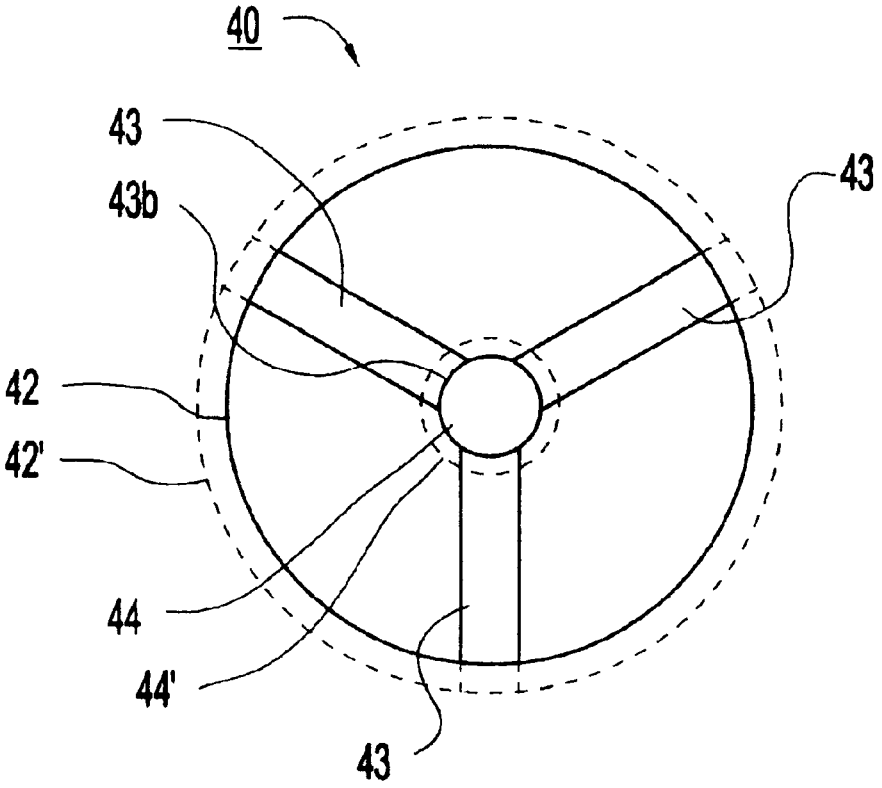
FIG. 5 is a schematic topview of a locking mechanism according to an alternative embodiment.

An alternative locking mechanism 40 is disclosed in FIG. 5. The locking mechanism 40 comprises a thermally controllable element in the form of a shape-memory metal ring 42 as well as three securing beams 43, which are mounted to the inner surface of the shape-memory metal ring 40 and extend perpendicularly from the circumference of the ring 40 towards the center point thereof. The respective second ends 43*b* of the securing beams 43 are concavely arc-shaped.

Figure 6:
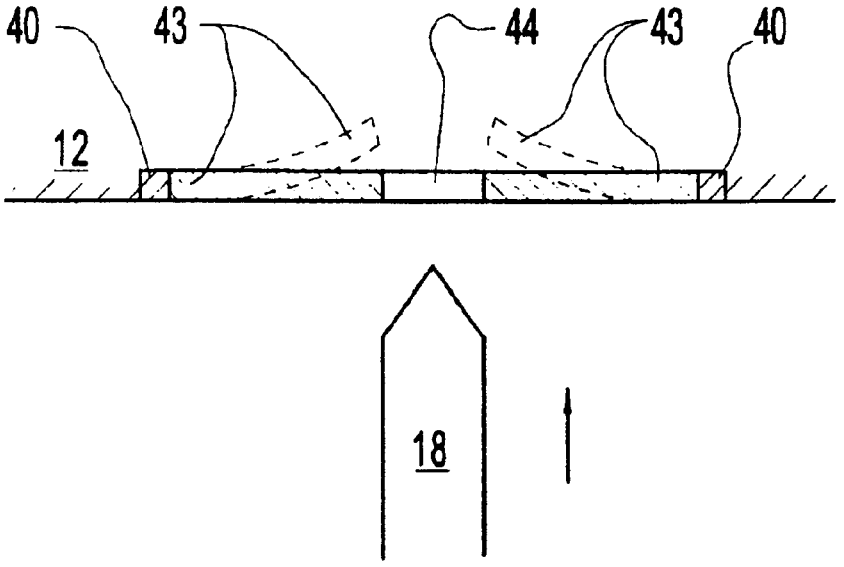
FIG. 6 is a schematic sideview of the embodiment of FIG. 5.

When the thermally controllable element 40 assumes its first or normal position, the second ends 43*b* of the securing beams 43 together form a circular opening 44. As shown in FIG. 6, the securing beams 43 are resiliently movable in one direction, namely towards the interior of the first housing element 12, i.e. upwards in FIG. 6. The pin 18 of the second housing element may thus be inserted between the three securing beams 43 into the first housing element 12. However, the securing beams 43 may not be moved in the opposite direction past their normal horizontal position, as described in FIG. 6. Thereby, once inserted into the opening 44, the pin 18 is prevented from being removed in the opposite direction.

To unlock the anti-theft device an authorized person operates the inductive heating device described above.

When the alternating magnetic field is induced into the conductive shape-memory metal ring 40, heat is generated therein. When the temperature of the shape-memory metal exceeds a predetermined limit, the diameter of the ring is increased at least 3–5%. As a consequence, the opening between the arc-shaped ends 43*b* of the securing beams 43 is enlarged, as indicated by a dashed circle 44'. The pin 18 may freely be removed from the first housing element 12, once the shape-memory metal ring 42 has entered its second position (which is indicated by a dashed circle 42' in FIG. 5).

According to another alternative embodiment of the present invention a separate induction receiver coil is connected in parallel to a releasing spring. The induction receiver coil is arranged to receive an alternating magnetic field generated by e.g. the external device described above, when operated by an authorized person, thereby generating an induced electric current, which is supplied through the releasing spring. As a consequence the releasing spring is heated, and when the temperature thereof exceeds a predetermined limit, the releasing spring switches to its second state, thereby assuming an extended position and releasing a male element.

As an alternative the thermally controllable element may be realized as a torsion helix, which is arranged to assume a first position during normal temperatures and a second position at temperatures exceeding a predetermined limit. In similarity to the above the torsion helix is arranged to engage and secure a pin of a second housing element, when the torsion helix assumes its first position, and to end the engagement of the pin, when the torsion helix assumes its second position.

As previously mentioned, an anti-theft device according to the present invention is preferably provided with theft-deterring means, for instance of any of the types described in section "Description of the Prior Art" above. Hence, the anti-theft device may comprise one or more than one fragile ampoules containing a discoloring and/or ill-smelling substance. Furthermore, the anti-theft device may be provided with a magnetic or electronic sensor or transponder, which may be detected by means of an electronic article surveillance system (EAS) known per se. Preferably, such a transponder comprises an amorphous magnetic element, the permeability of which is controllable by means of an externally generated magnetic field. Optionally, the amorphous magnetic element may be inductively coupled to an electronic resonance circuit, the resonance frequency of which depends on the permeability of the amorphous element.

The present invention has been described above with reference to a few embodiments for exemplifying but not limiting reasons. As will be readily understood by a man skilled in the art, the present invention may be realized in other ways than the ones described, and the scope of the present invention is only limited by the definitions in the appended independent patent claims. In particular it is to be noted that the thermally controllable element may be heated by other means than an inductive heating device. Furthermore, the female portion of the locking mechanism may employ other means than retaining balls, for instance teeth or hooks, and the male portion does not have to be essentially pin-shaped. In addition, the thermally controllable element may be made from other materials than metals exhibiting a SME effect. One such alternative material is a bimetal.

What is claimed is:

1. An anti-theft device for deterring theft of a protected article, the device comprising a first housing element comprising a female portion;

a second housing element comprising a male portion;

a locking mechanism adapted for releasably securing the male portion of the second housing element to the female portion of the first housing element, the locking mechanism comprising a thermally controllable element adapted to assume a first position at temperatures below a predetermined limit wherein the locking mechanism locks the male portion to the female portion, and a second position at temperatures above the predetermined limit wherein the locking mechanism releases the male portion from the female portion; and heat generating means in thermal communication with the thermally controllable element, the heat generating means being adapted for receiving electromagnetic energy and generating heat therefrom so as to heat the thermally controllable element.

2. An anti-theft device according to claim 1, wherein the thermally controllable element comprises a material exhibiting a shape-memory effect.

3. An anti-theft device according to claim 1, wherein the thermally controllable element comprises bimetallic material.

4. An anti-theft device according to claim 1, wherein the heat generating means are comprised by the thermally controllable element.

5. An anti-theft device according to claim 1, wherein the heat generating means comprise an inductive coil connected in parallel to the thermally controllable element.

6. An anti-theft device according to claim 1, wherein the thermally controllable element is adapted to be heated via induced magnetic energy.

7. An anti-theft device according to claim 1, further comprising at least one enclosed space containing a marking fluid, and means for breaking the enclosed space in response to an unauthorized attempt to remove the male portion from the female portion.

8. An anti-theft device according to claim 7, wherein the marking fluid is a discoloring fluid.

9. An anti-theft device according to claim 7, wherein the marking fluid is an ill-smelling fluid.

10. An anti-theft device according to claim 1, further comprising means for generating a signal representative of an alarm condition in response to the reception of an interrogation signal.

11. An anti-theft device according to claim 10, wherein said means for generating a signal representative of an alarm condition comprises an amorphous magnetic element.

12. An anti-theft device according to claim 10, wherein said means for generating a signal representative of an alarm condition comprises an electronic resonance circuit.

13. An anti-theft device according to claim 1, wherein the predetermined limit is greater than 100 degrees Celsius.

14. An anti-theft device according to claim 1, wherein the thermally controllable element comprises a nonmagnetic material.

15. An anti-theft device according to claim 1, wherein the thermally controllable element comprises a nickel-titanium alloy.

16. An anti-theft device according to claim 1, wherein the thermally controllable element is adapted to be heated via microwaves.

17. An anti-theft device according to claim 1, wherein the thermally controllable element is adapted to be heated via radio waves.

18. An anti-theft device according to claim 1, wherein the heat generating means is adapted for receiving electromagnetic energy and converting the electro-magnetic energy to electricity, and for generating heat from the electricity.

19. An anti-theft device for deterring theft of a protected article, the device comprising a first housing element comprising a female portion;

a second housing element comprising a male portion;

a locking mechanism adapted for releasably securing the male portion of the second housing element to the female portion of the first housing element, the locking mechanism comprising a thermally controllable element adapted to assume a first position at temperatures below a predetermined limit wherein the locking mechanism locks the male portion to the female portion, and a second position at temperatures above the predetermined limit wherein the locking mechanism releases the male portion from the female portion;

heat generating means in thermal communication with the thermally controllable element, the heat generating means being adapted for receiving electromagnetic energy and generating heat therefrom so as to heat the thermally controllable element;

wherein the first housing element comprises a spring biased insert and at least two retaining balls contained therein;

the female portion is in the form of a bore adapted for receiving the male portion of the second housing element;

the device comprises a spring coil adapted for biasing the spring biased insert, such that the retaining balls are urged into frictional engagement with the male portion, thereby securing the male portion within the female portion;

the thermally controllable element is arranged with respect to the biasing spring coil such that the thermally controllable element is adapted to counteract a biasing force of the biasing spring coil so as to release the frictional engagement between the retaining balls and the male portion when the thermally controllable element is heated to a temperature above the predetermined limit; and the thermally controllable element is adapted to be heated via induced magnetic energy.

* * * * *